US006140592A

United States Patent [19]

Paterek et al.

[11] Patent Number: 6,140,592

[45] **Date of Patent: *Oct. 31, 2000**

[54] SEAL FOR HERMETIC TERMINAL ASSEMBLIES

[75] Inventors: F. Dieter Paterek, County of Hamilton, Ohio; Richard L. Teaford, County of Campbell, Ky.

[73] Assignee: Emerson Electric Co., St. Louis, Mo.

[ * ] Notice: This patent is subject to a terminal disclaimer.

[21] Appl. No.: 08/495,699

[22] Filed: Jun. 27, 1995

Related U.S. Application Data

[63] Continuation of application No. 07/906,228, Jun. 26, 1992, Pat. No. 5,471,015.

[51] Int. Cl.[7] ..... H01B 17/30

[52] U.S. Cl. ..... 174/152 GM; 439/926

[58] Field of Search ..... 174/152 GM, 153 R, 174/50.58, 50.61, 50.63; 439/621, 926

[56] References Cited

U.S. PATENT DOCUMENTS

| | | | |
|---|---|---|---|
| 3,949,335 | 4/1976 | Morgan | 335/154 |
| 4,580,003 | 4/1986 | Bowsky et al. | 174/152 GM |
| 4,584,433 | 4/1986 | Bowsky et al. | 174/152 GM |
| 4,609,774 | 9/1986 | LeMieux et al. | 174/152 GM |
| 4,866,010 | 9/1989 | Boulous et al. | 501/71 |
| 4,873,206 | 10/1989 | Jones | 501/71 |
| 4,888,039 | 12/1989 | Bowsky | 65/139 |
| 5,017,740 | 5/1991 | Honkomp et al. | 174/152 GM |
| 5,471,015 | 11/1995 | Paterek et al. | 174/152 GM |

*Primary Examiner*—Hyung-Sub Sough
*Attorney, Agent, or Firm*—Polster, Lieder, Woodruff & Lucchesi, L.C.

[57] ABSTRACT

An improved fuse associated current conducting pin and sealing structure for a hermetic terminal assembly wall wherein the sealing member has a preselected coefficient of expansion compatible with that of the pin and wall and a softening point temperature in excess of the conducting temperature of the pin surface occasioned by fuse melting.

7 Claims, 1 Drawing Sheet

SEAL FOR HERMETIC TERMINAL ASSEMBLIES

This is a continuation of Ser. No. 07/906,228 which was filed on Jun. 26, 1992, now U.S. Pat. No. 5,471,015.

BACKGROUND OF THE INVENTION

The present invention relates to hermetic terminal assemblies and more particularly to a unique sealing structure for hermetic terminal assemblies.

Sealing members between the pin and walls of terminal assemblies have long been known in the art, particularly those of a type wherein a metallic cup-shaped body is utilized to cover and seal an opening in a hermetically sealed housing, the metallic cup-shaped body including at least one aperture with an annular lip extending therearound, the aperture serving to accommodate an electrically conductive metallic pin extending therethrough. A suitable fuse member has been associated with the electrically conductive pin and the pin has been sealed to the annular lip extending around the aperture in the cup-shaped body by a suitable sealing member such as glass. Several types of such glass-to-metal hermetic terminal assembly arrangements can be found in the art, such as in U.S. Pat. No. 4,580,003, issued on Apr. 1, 1986 to B. Bowsky et al, U.S. Pat. No. 4,584,433, issued on Apr. 22, 1986 to B. Bowsky et al and U.S. Pat. No. 5,017,740, issued to G. Honkomp et al on May 21, 1991. The art also has recognized that weakened hermetic seals have developed in the glass-to-metal sealing arrangements and has reduced occurrence of undesirable voids in the glass seal by controlling heating and glass flow in a preselected direction, attention being directed to U.S. Pat. No. 4,888,039, issued to B. Bowsky on Dec. 19, 1989, wherein an upwardly directed glass flow heating gradient has been utilized to flow glass sleeves forming sealing members around electrically conductive pins from bottom to top to firmly fuse the terminal pins with minimal voids in the glass sleeves. The present invention recognizes the importance of maintaining a proper durable sealing relation of a conductive pin in a hermetic terminal assembly structure not only in the formation of the conductive pin seal but also in the operation of such conductive pin seal under extraordinary stressful and heated conditions—such as during periods of extraordinary current swells which produce temperature rises to undesirable levels so as to cause associated fuse melting with concomitant electrical current interruption through the conductive pin. The present invention recognizes the importance of maintaining the integrity of the overall system to permit this preselected current interruption during excessive operation conditions and, particularly the importance of maintaining the integrity of the pin sealing members during accompanying excessive heats. Recognizing the possibilities of sealing member melt occurrence prior to appropriate fuse functioning, the present invention resolves this problem in a straight-forward and economical manner by employing a unique sealing member which has preselected physical properties compatible with the materials with which it engages and preselectively compatible with conditions associated with fuse melting. To do this, the present invention recognizes and utilizes sealing materials which include chemical composition characteristics of a type generally known in the art and which in accordance with the present invention are employed to insure appropriate operational performance capability of fusing elements associated with electrical conductive pins during undesirable current surges with accompanying higher heat levels. In this regard, the present invention recognizes the unique value of employing sealing materials having high temperature melting characteristics, such high temperature melting glasses long known in the art and generally described in detail in such U.S. Pat. No. 3,949,335, issued to D. W. Morgan on Apr. 6, 1976, U.S. Pat. No. 4,866,010, issued to E. N. Boulos et al on Sep. 12, 1989, and U.S. Pat. No. 4,873,206, issued to J. V. Jones on Oct. 10, 1989. In addition, the present invention provides a unique high temperature melting glass with chemical characteristics similar to those high temperature melting glasses generally known in the art but with special chemical characteristics particularly adaptive to the sealing area in which such glass is destined to be employed.

Various other features of the present invention will become obvious to one skillet in the art upon reading the disclosure set forth herein.

BRIEF SUMMARY OF THE INVENTION

More particularly, the present invention, provides in a hermetic terminal assembly housing wall, an improved fuse associated current conducting pin and sealing structure disposed in a wall defined aperture extending between opposed inner and outer faces of a portion of the housing wall comprising; a current conducting pin extending in spaced relation through the wall defined aperture from the outer face to the inner face of the wall defining aperture; and, a sealing member surrounding and extending radially between the peripheral surface of the pin and the wall defined aperture to hermetically seal the current conducting pin in the aperture, the sealing member having a preselected coefficient of expansion compatible with the coefficient of expansion of the pin and the wall defining the aperture and a softening or melting point temperature in excess of the conductive heat temperature adjacent the surrounding peripheral surface area of the pin occasioned by fuse melting to avoid melting and venting through the sealing member. In addition, the present invention provides a unique high temperature glass with a coefficient of expansion being in the proximate range of 87 to $94\times10^{-7}$ /in./in. °C. at temperatures ranging approximately from 20° to 300° C. with a softening point in the range of approximately 685° to 825° C. and comprised approximately by weight of 50–65% $SiO_2$, 1–5% $B_2O_3$, 8–15% $A_{_2}O_3$, 15–20% light metal oxides of the first metal group of the periodic chemical table and 15–20% light metal oxides of the second metal group of the periodic chemical table.

It is to be understood that various changes can be made by one skilled in the art in several parts of the structure and in the chemical compositions disclosed herein without departing from the scope or spirit of the present invention.

BRIEF DISCUSSION OF THE DRAWINGS

Referring to the drawing which disclosed one advantageous embodiment of he inventive glass to metal sealing structure:

FIG. 1 is a view, partly in section and partly broken away of a typical terminal assembly which can incorporate the novel glass to metal seal of the present invention; and, FIG. 2 is an end view of the assembly of FIG. 1 taken in a plane tough line 2—2 of FIG. 1.

DETAILED DESCRIPTION OF THE DRAWINGS

Figure 1:
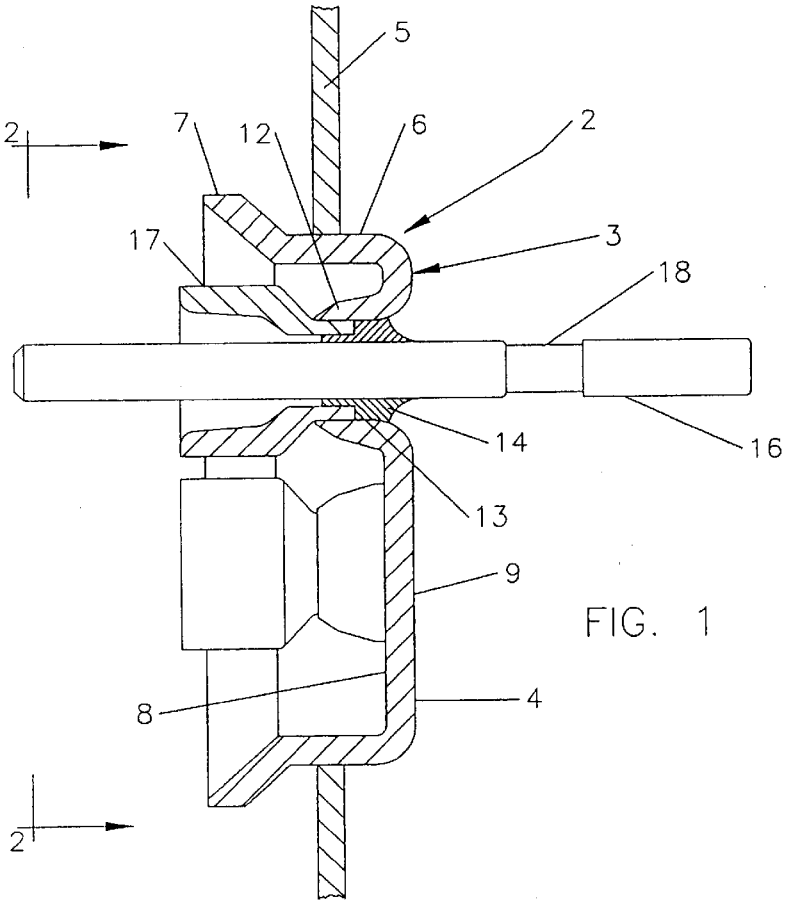
Figure 2:
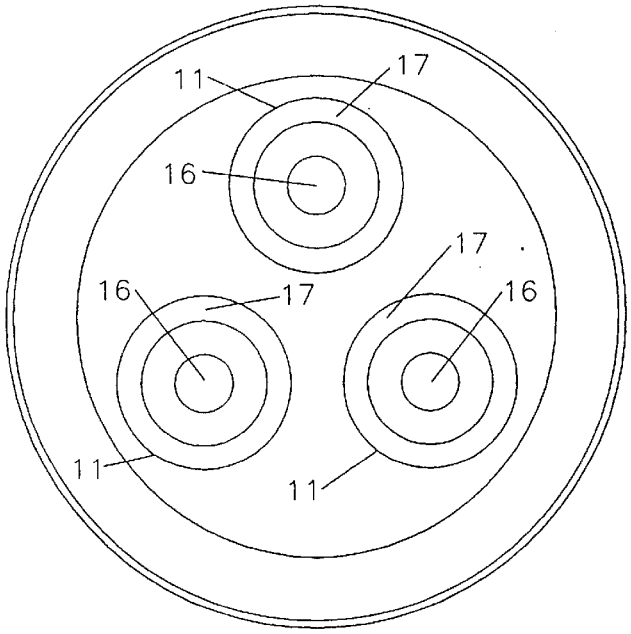

As can be seen in FIG. 1, a typical metal seal for a hermetically sealed fuse associated terminal pin is disclosed as part of a hermetic terminal assembly. The assembly structure of the drawings is substantially like that set forth in above mentioned U.S. Pat. No. 4,584,433 with the flange portion adjacent the fuse area having been omitted. It is to be understood that such a flange does not comprise a critical part of the present invention and could or could not be included. Of course, as will be seen hereinafter, the need for such a flange would not be as great since the integrity of the seal has been improved in the existing environment. As can be seen in the figures of the drawings, the hermetic terminal assembly as shown and in which the unique sealing features of the present invention can be included is broadly indicated by references numeral 2 to a cover member 3 in the form of a cup-shaped body which has a generally flat bottom 4 and a sidewall 6 with an outwardly flaring rim 7. The outer periphery of sidewall 6 is hermetically sealed to wall 5. of a hermetic housing. Only a portion of the housing is disclosed since the housing and the manner of hermetically sealing body 3 thereto which can be by fusion—do not constitute a critical part of the present invention. The flat bottom 4 as disclosed has a dished or inner surface 8 and an outer or outside surface 9 and at least one hole or opening 11 defined by annular sealing lip 12 extending from inner surface 8 with an inside surface 13 with which the unique seal 14 of the present invention engages in hermetically sealing relation therein. As can be seen in FIG. 2, cup-shaped body 3, in fact, is provided with three such openings 11, all of which can incorporate similar novel annular sealing lip arrangements as described herein, each including a current conductive pin 16 with the outer end serving to be connected to a suitable electric current source (not shown) and the inner end extending beyond annular lip 12 and the ceramic sleeve 17 to receive an electrical connection disposed in the housing defined by housing wall 5. Each pin 16 is provided with a reduced or necked portion 18 which is spacedly surround by ceramic sleeve 17 and which serves as a fuse element. As is known in the art, fuse associated pin 16 and cover 3 can be formed by a suitable forming process from a corrosion resistant stainless steel with a high chromium content or other suitable metal compositions to enhance the bonding process of the pin 16 and seal 14 and the fuse 18 can be associated with either the upstream or downstream portion of pin 16 separately or an integral part thereof.

In accordance with the present invention, seal 14 which extends radially between the peripheral surface of pin 16 and lip wall 13 and in which ceramic sleeve 17 is embedded is of an inventively preselected material. Although it is possible that the preselected material can be of different chemical compositions, it is inventively important that it have a preselected coefficient of expansion compatible with the coefficient of expansion of pin 16 and the lip wall 13 defining the pin aperture 11. Further, in accordance with the present invention, seal 14 should have a softening point temperature in excess of the conductive heat temperature adjacent the surrounding peripheral surface area of pin 16 which can be occasioned by the melting of the pin associated fuse 18 to avoid the melting of seal 14 and venting of the housing therethrough.

Advantageously, the sealing member can be a high temperature glass composition having a preselected high temperature softening point in the range of approximately 685° to 825° C. and comprised approximately by weight of 50–65% $SiO_2$, 1–5% $B_2O_3$, 8–15% $Al_2O_3$, 15–20% light metal oxides of the first metal group of the periodic chemical table and 15–20% light metal oxides of the periodic chemical table having softening points in the range of 750° to 825° C. with a coefficient of thermal expansion in the range of 87 to $94\times10^{-7}$ in./in. °C. at temperatures ranging from 20° to 300° C. Further, in accordance with one embodiment of the present invention, the sealing member 14 can have a softening point of approximately 800° C. and comprised approximately by weight of 59% $SiO_2$, 14% BaO, 11% $Al_2O_3$, 7% $K_2P$. 6% NaO, 2% CaO and 1% $B_2O_3$.

Thus, in accordance with the present invention further assurance is provided against venting of the housing by assuring that fuses 16 melt in the event of current surges well before temperatures reach the melting temperatures of the sealing members 14.

The invention claimed is:

1. A hermetic terminal assembly housing wall comprising;

a wall defined aperture extending between opposed inner and outer faces of a portion of said housing wall;

an integral, unitary current conducting pin of the same material throughout from one end thereof to an opposite end thereof, said pin extending in spaced relation through said wall defined aperture from said outer face to said inner face of said wall defining aperture with a smaller preselected portion of said pin having a preselected integrally associated smaller cross-sectional area to act as a fuse, and, a sealing member surrounding and extending radially between the peripheral surface of said integral, unitary pin and said wall defined aperture to hermetically seal said current conducting integral, unitary pin in said aperture, said sealing member having a preselected coefficient of expansion compatible with the coefficient of expansion of said pin and said wall defining said aperture and a softening point temperature in excess of the conductive heat temperature adjacent the surrounded periphery surface area of the pin occasioned by melting of said fuse to avoid melting and venting through said sealing member.

2. The hermetic terminal assembly housing wall of claim 1, said defined aperture being part of a metallic body member closing a housing opening and having a lip portion peripherally surrounding said wall defined aperture in which said fuse associated current conducting pin is disposed, said metallic body member having a preselected coefficient of expansion compatible with said sealing member.

3. The hermetic terminal assembly housing wall of claim 1, said integral fuse of said integral fuse associated current conducting integral unitary pin being upstream of said pin and a part thereof.

4. The hermetic terminal assembly housing wall of claim 1, said integral unitary pin and wall defining aperture being of a preselected ferrochromium composition and said sealing member being a glass having a preselected high temperature softening point.

5. The hermetic terminal housing wall of claim 1, said sealing member being a glass having a preselected high temperature softening point in the range of approximately 685° to 825° C.

6. The hermetic terminal assembly housing wall of claim 1, said preselected coefficient of expansion of said sealing member being in the approximate range of 87 to $94\times10^{-7}$ in./in. °C. at temperatures ranging approximately from 20° to 300° C.

7. The hermetic terminal assembly housing wall of claim 1, said integral fuse of said integral fuse associated current conducting integral, unitary pin being downstream of said integral, unitary pin and a part thereof.

* * * * *

UNITED STATES PATENT AND TRADEMARK OFFICE

CERTIFICATE OF CORRECTION

PATENT NO. : 6,140,592
DATED : October 31, 2000
INVENTOR(S) : F. Dieter Paterek; Richard L. Teaford It is certified that error appears in the above-identified patent and that said Letters Patent is hereby corrected as shown below:

Column 2,
Line 14 replace "skillet"with --skilled--

Column 2,
Line 54 replace "he" with --the--

Column 2,
Line 61replace "tough" with --through--

Column 4,
Line 46 replace "integral unitary" with --integral, unitary--

Signed and Sealed this

Twelfth Day of June, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,140,592
DATED : October 31, 2000
INVENTOR(S) : F. Dieter Paterek; Richard L. Teaford It is certified that error appears in the above-identified patent and that said Letters Patent is hereby corrected as shown below:

Column 2,
Line 14 replace "skillet"with --skilled--

Column 2,
Line 54 replace "he" with --the--

Column 2,
Line 61 replace "tough" with --through--

Column 4,
Line 46 replace "integral unitary" with --integral, unitary--

Signed and Sealed this

Twenty-sixth Day of June, 2001

Nicholas P. Godici

*Attest:*

*Attesting Officer*

NICHOLAS P. GODICI
*Acting Director of the United States Patent and Trademark Office*